US008925619B2

(12) United States Patent
Frezouls et al.

(10) Patent No.: US 8,925,619 B2
(45) Date of Patent: Jan. 6, 2015

(54) MODULAR PARTITION SYSTEM

(75) Inventors: Francois Frezouls, Paris (FR); Philippe Beille, Calvisson (FR)

(73) Assignee: Duo Industrie, Lansargues (FR)

( * ) Notice: Subject to any disclaimer, the term of this patent is extended or adjusted under 35 U.S.C. 154(b) by 758 days.

(21) Appl. No.: 12/769,340

(22) Filed: Apr. 28, 2010

(65) Prior Publication Data

US 2011/0192555 A1 Aug. 11, 2011

(51) Int. Cl.

| | |
|---|---|
| ***A47G 5/00*** | (2006.01) |
| ***E06B 3/30*** | (2006.01) |
| ***E06B 9/24*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/74*** | (2006.01) |
| ***E04B 2/78*** | (2006.01) |

(52) U.S. Cl.

CPC ..... *E04B 2/7433* (2013.01); *E04B 2/7818* (2013.01); *E04B 2002/7479* (2013.01)

USPC ..... 160/378; 160/351; 160/135; 52/238.1; 52/239

(58) Field of Classification Search

USPC ..... 160/135, 351, 378, 391, 394, 395, 397; 52/238.1, 239, 273, 276, 282.2, 222, 52/73, 74, 36.4

See application file for complete search history.

(56) References Cited

U.S. PATENT DOCUMENTS

| | | | | |
|---|---|---|---|---|
| 3,370,389 | A * | 2/1968 | Macaluso | 52/239 |
| 4,021,973 | A * | 5/1977 | Hegg et al. | 52/36.6 |
| 4,689,929 | A * | 9/1987 | Wright | 52/239 |
| 6,223,485 | B1 | 5/2001 | Beck et al. | |
| 2008/0104922 | A1 * | 5/2008 | Glick et al. | 52/630 |
| 2008/0148684 | A1 | 6/2008 | Bruder | |

FOREIGN PATENT DOCUMENTS

| | | | |
|---|---|---|---|
| DE | 202006018839 | U1 | 2/2007 |
| EP | 1749948 | A2 | 2/2007 |

OTHER PUBLICATIONS

"Graphic System RGS Aluminum profiles for canvas and material" brochure by ACRYLLAND with affidavit of publication on or about Feb. 2008.

* cited by examiner

*Primary Examiner* — Katherine Mitchell
*Assistant Examiner* — Jeremy Ramsey
(74) *Attorney, Agent, or Firm* — Andrew W. Chu; Craft Chu PLLC

(57) ABSTRACT

The present invention is a modular partition system obtained by assembling removable elements. The system includes at least one mast and at least one panel made integral with each other. The panel includes a frame, on at least one face of which is stretched a canvas. The frame includes a retainer to this end of stretching, on its perimeter and longitudinally. The canvas includes, on the perimeter of its rear face, a hooking device aimed at cooperating with the retainer. The mast includes a profile, or an assembly of profiles, each profile having a device designed capable of permitting directly or indirectly fastening the panel. The present invention is essentially characterized in that the mast includes a device for retaining a mast canvas, at least a portion of which is aimed at covering at least the portion of the mast that is visible.

13 Claims, 3 Drawing Sheets

MODULAR PARTITION SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a modular partition system obtained by assembling removable elements.

The present invention relates in particular to the partitions formed by assembling panels, each being formed of a rigid frame serving as a support for a canvas or the like, eventually including an image. To this end, each frame essentially comprises two stiles and two longitudinal beams assembled two by two at right angles, which consist of profiles having, at the front, a longitudinal groove aimed at receiving and retaining a hooking element protruding out of the rear face of the canvas, so that, after driving this element into the grooves of the profiles of the frame, the latter is completely hidden. The hooking element generally consists of either a bead made out of elastic material or a cord or the like made out of elastic material connected to the canvas, said material being for example silicone.

2. Description of Related Art Including Information Disclosed Under 37 CFR 1.97 and 37 CFR 1.98

In general, the panels are maintained by masts, which each consist of a profile, or an assembly of profiles, comprising means designed capable of permitting to fasten, directly or indirectly, one or several panels, or accessories such as, non-restrictively, racks. Thus, a mast includes longitudinal retaining grooves aimed at receiving either a portion of the panel to be carried or an element permitting to hook the panel thereon.

Irrespective of their design, all presently known modular partition systems have the same drawback, namely that each mast remains visible, and constitutes an interruption of the image, the more when it is arranged between at least two panels, and the more when said at least two panels serve as a support for only one image.

SUMMARY OF THE INVENTION

The aim of the present invention is to provide a modular partition system obtained by assembling removable elements, permitting to cope with this drawback of interruption of the image.

The modular partition system obtained by assembling removable elements according to the invention comprises at least one mast and at least one panel made integral with each other. The panel consists of a frame, on at least one face of which is stretched a canvas, said frame comprising to this end, on its perimeter and longitudinally, retaining means. The canvas includes, on the perimeter of its rear face, hooking means aimed at cooperating with said retaining means, while said mast consists of a profile, or an assembly of profiles, comprising means designed capable of permitting to directly or indirectly hook said panel, and it is essentially characterized in that said mast includes, in addition, means for retaining a canvas, at least a portion of which is aimed at covering at least the portion of said mast that is visible.

According to an additional feature of the modular system according to the invention, the means for retaining a canvas are distributed over the perimeter of the mast.

According to another additional feature of the modular system according to the invention, the means for retaining a canvas are positioned alternately with the retaining means designed capable of permitting the fastening of the panels.

According to another additional feature of the modular system according to the invention, each retaining means capable of permitting the fastening of the panels is bordered on both sides by means for retaining a canvas.

According to another additional feature of the device according to the invention, the mast includes, at least at one end, means for fastening a cap, which peripherally includes means for retaining a canvas.

According to another additional feature of the device according to the invention, the mast includes, at least at one end, namely its upper end, means for fastening a cap, which is shaped so to create, in co-operation with the outermost edge of said mast, peripheral means for retaining a canvas.

According to a particular embodiment of the modular system according to the invention, the mast has a square cross-section, its width being equal to twice the thickness of a panel.

According to an additional feature of the particular embodiment of the modular system according to the invention, each face of the mast includes two retaining means capable of permitting the fastening of a panel, separated by two means for retaining a canvas, while each edge includes means for retaining a canvas, common to the two faces forming said edge.

According to another particular embodiment of the modular system according to the invention, the mast has a rectangular cross-section. It includes, on the one hand, two opposite faces, each comprising two retaining means capable of permitting the fastening of a panel, separated by two means for retaining a canvas, and on the other hand, two faces each comprising retaining means capable of permitting the fastening of a panel, while each edge includes means for retaining a canvas, common to the two faces forming said edge.

According to another particular embodiment of the modular system according to the invention, the mast has an L-shaped cross-section. It includes, on the one hand, two adjacent faces, each face comprising two retaining means capable of permitting the hooking on of a panel, separated by two means for retaining a canvas, and on the other hand, four faces forming between them, two by two, a right angle and each face comprising retaining means capable of permitting the fastening of a panel, while each external edge includes means for retaining a canvas common to the two faces forming said edge, and that the re-entrant edge includes one or two means for retaining a canvas.

According to another additional feature of the modular system according to the invention, each means for retaining a canvas is in the form of a longitudinal groove.

According to another additional feature of the modular system according to the invention, the means for retaining a canvas are, each, in the form of a groove having a rectangular cross-section, the axis of which parallel to the length of this rectangle is oriented towards the inside of the mast.

The advantages and features of the device according to the invention will clearly appear from the following description that refers to the attached drawings, which represent several non-restrictive embodiments of the same.

DETAILED DESCRIPTION OF THE DRAWINGS

Figure 1:
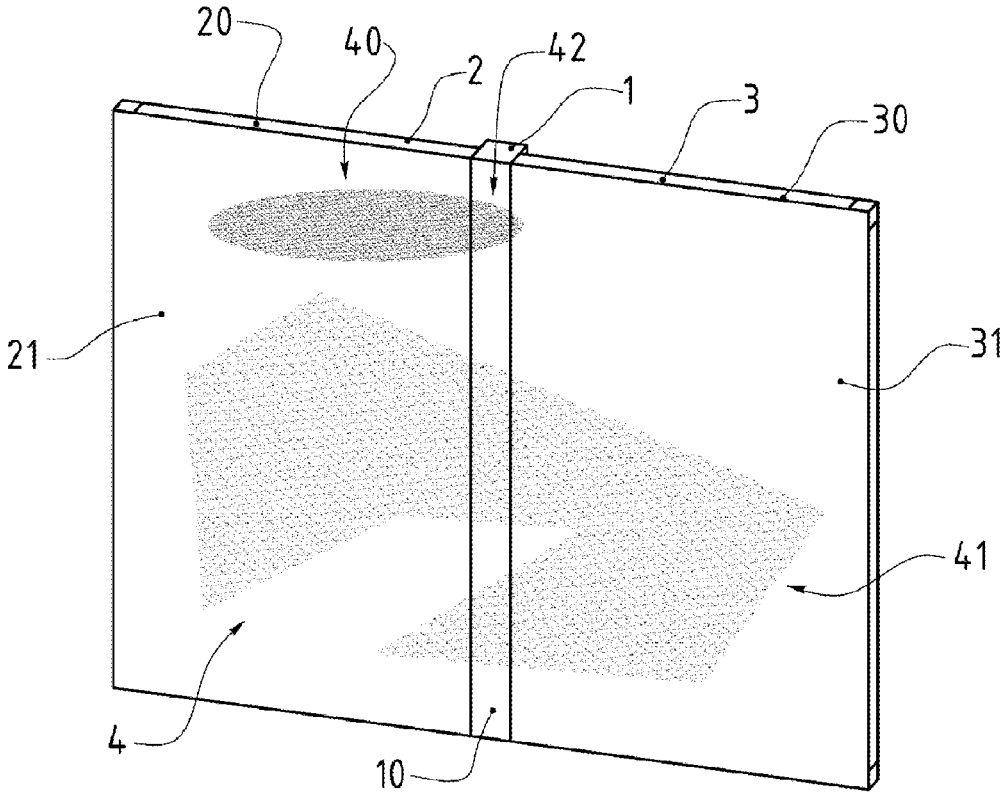
FIG. 1 shows a perspective view of a modular system according to the invention.

Referring to FIG. 1, one can see a modular system according to the invention, which, in this configuration, comprises a mast 1 and two panels 2.

The panel 2 comprises a frame 20 covered with a canvas or the like 21, while the panel 3 also comprises a frame 30 covered with a canvas or the like 31.

The modular system carries an image 4, a portion 40 of which is reproduced on the canvas 21, while another portion 41 is reproduced on the canvas 31, and that according to the invention the mast 1 is covered, at the level of its face, which is not visible and extends between the panels 2 and 3, with a canvas 10 on which is reproduced a portion 42 of the image 4 that constitutes the junction between the portions 40 and 41, so as to achieve its continuity.

Figure 2:
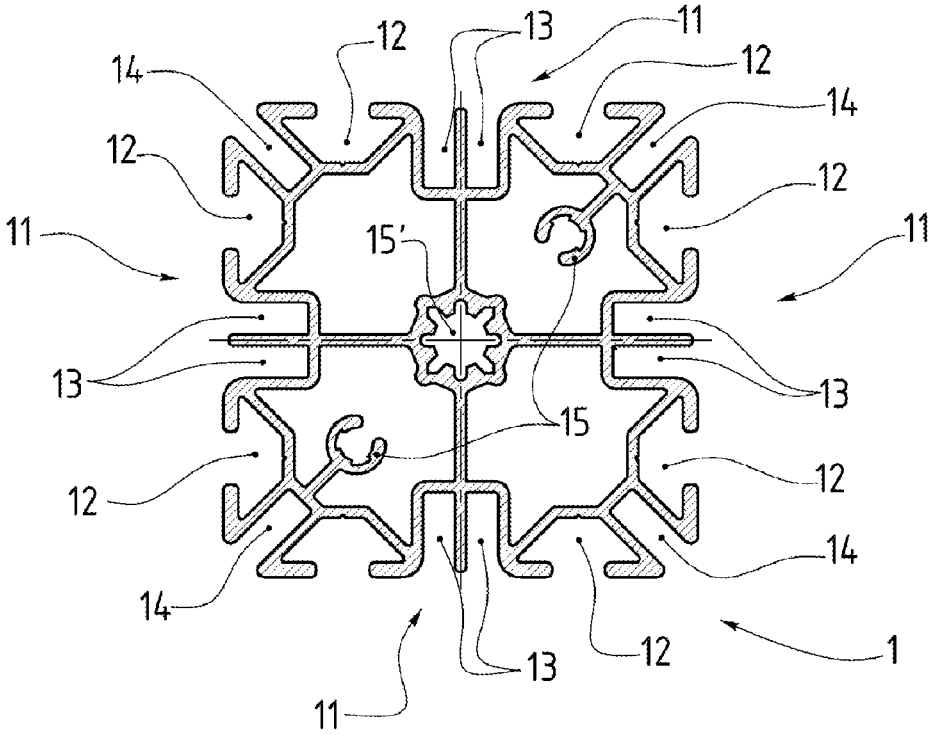
FIG. 2 shows a transverse cross-sectional view of an element of the same modular system.

This result is achieved because of the characteristics of the mast 1, the transverse cross-section of which is shown in FIG. 2.

In this FIG. 2, one can see that the mast 1, which consists of a profile, has, in this embodiment, a square cross-section, four identical faces 11, each comprising, open outwardly, two retaining grooves 12 with a trapezoidal cross-section, separated by two median grooves 13 with a rectangular cross-section the large side of which is perpendicular to the face considered. Each corner includes a bevel groove 14 with a rectangular cross-section, identical for each groove 13, and the axis of symmetry of which parallel to the large side coincides with the diagonal line of the square.

The retaining grooves 12 are intended for the fastening of the panels 2 or 3, while the grooves 13 and 14 are intended for the fastening of the canvas 10, as will be explained below.

It should be noted that the number and the arrangement of the grooves 13 and 14 are not limited; it is thus perfectly possible to contemplate two bevel grooves 14 side by side.

Figure 3A:
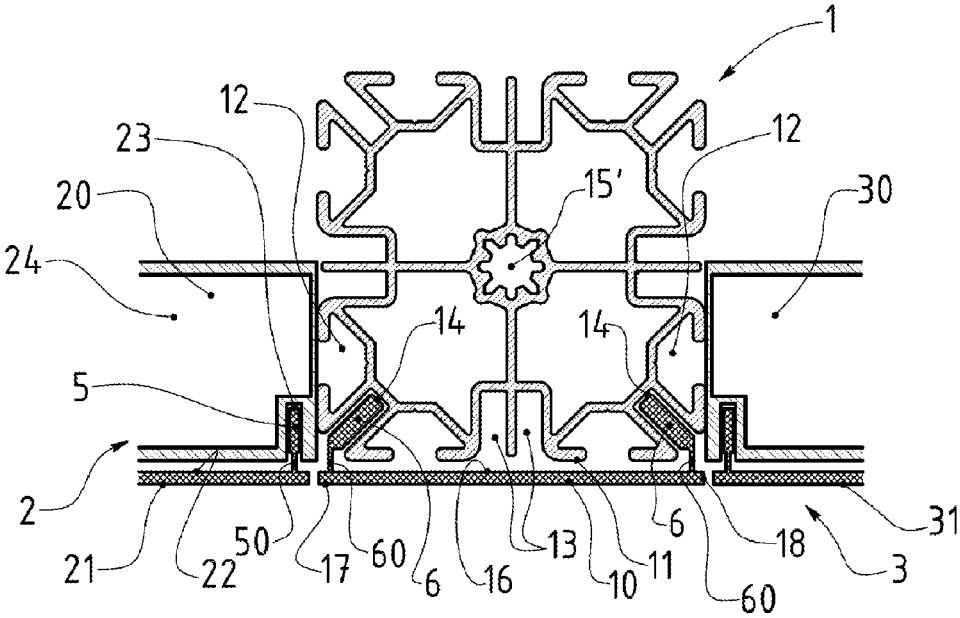
FIGS. 3*a*, 3*b*, 3*c*, 3*d* and 3*e* show partial transverse cross-sectional views of the same modular system in different configurations.
Figure 3B:
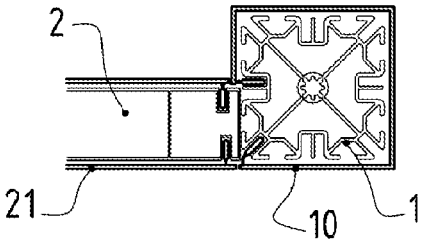
Figure 3C:
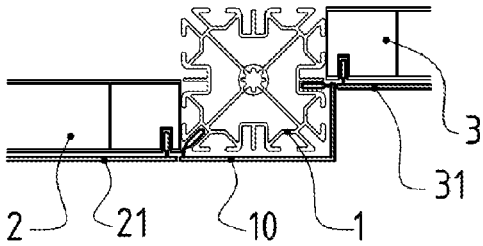
Figure 3D:
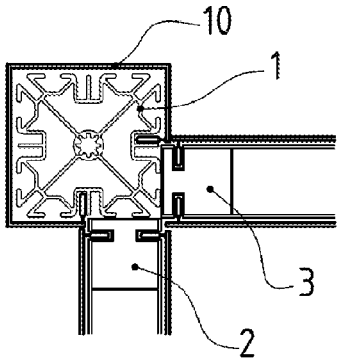
Figure 3E:
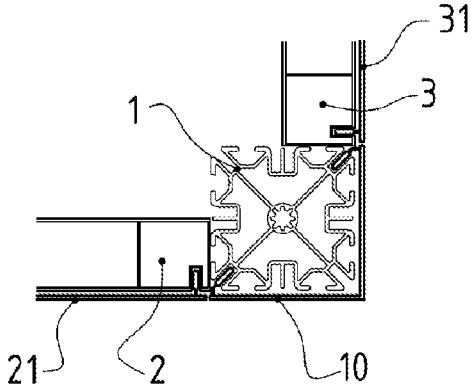

When referring now to FIG. 3*a*, one can see a transverse cross-sectional view of the same modular system at the level of the mast 1.

It should be noted that in the embodiment shown, the mast 1 has a square cross-section and a width that is twice the thickness of the panel 2 or the panel 3.

The fixing of the canvas 21 to the frame 20 occurs in a way known per se, through a cord 5 of elastic material, such as silicone, arranged on the perimeter of the canvas 21, protruding out of its inner surface 22, namely the one that does not include an image, and connected to the latter through connecting means 50, and inserted in a groove 23 the frame 20 includes on its perimeter, in this case in a stile 24 of this frame 20.

The panel 2 is in addition fixed to the mast 1, which occurs through a retaining groove 12 in front of which the panel 2 extends, and through an element, not shown, integral with the frame 20 and aimed at being inserted into the retaining groove 12.

The frame 30 is fixed in the same way to the mast 1, on the opposite face 11, and the canvas 31 is fixed to the frame 30 of the panel 3, in the same way as the canvas 21 to the frame 20.

The fixing of the canvas 10 to the mast 1 occurs according to the same technique as the one used for fixing the canvass 21 and 31, i.e. the canvas 10 includes on its rear face 16, on its perimeter, or at least along its vertical edges 17 and 18, a cord 6 of elastic material, such as silicone, which is connected to same through connecting means 60 that enable an easy fastening.

Thus, the cord 6 of the edge 17 of the canvas 10 is inserted into the bevel groove 14 common to the face 11, which the frame 20 is made integral with, and to the face 11 aimed at being covered, while the cord 6 of the edge 18 of the canvas, parallel to the edge 17, is inserted into the bevel groove 14 common to the face 11 aimed at being covered and to the face 11, which the frame 30 is made integral with.

It should be noted that the mast 1 according to the invention advantageously permits to omit, if necessary, using a frame comprising two stiles and two longitudinal beams, and to use only longitudinal beams, made firmly integral by their ends between two masts 1, the canvas covering the frame being made integral directly to the masts 1.

It should also be noted that the mast 1 includes, non-restrictively, two internal grooves 15, and an axial channel 15', aimed at fastening a cap at the end of the mast 1, which will be described below.

When referring now to FIGS. 3*b*, 3*c*, 3*d* and 3*e*, one can see various configurations of the modular system according to the invention, depending on the number of panels and the location at which they are made integral with the mast 1. Depending on the portion of the mast 1 to be covered, the cords 6 are inserted into a bevel groove 14, or into a median groove 13.

Figure 4:
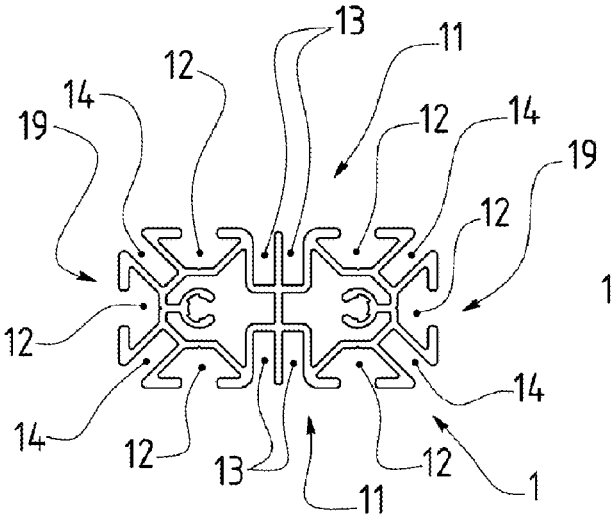
FIG. 4 shows a transverse cross-sectional view of another element of the modular system according to the invention.
Figure 5:
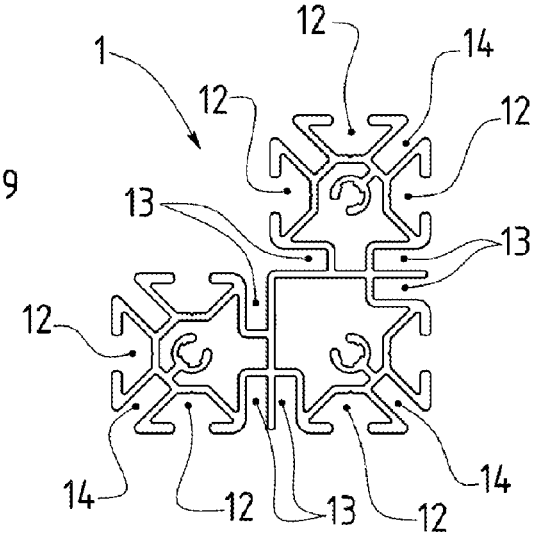
FIG. 5 shows a transverse cross-sectional view of another element of the modular system according to the invention.

When referring now to FIGS. 4 and 5, one can see different embodiments of the mast 1.

In FIG. 4, the mast 1 has a rectangular cross-section, i.e. its width is equal to that of a panel, and a length twice as large, which permits for example to join two panels in the extension of each other without extra thickness.

Thus, this mast 1 includes two parallel faces 11, each including two retaining grooves 12 separated by two median grooves 13, and two parallel faces 19 having half the width, which each include one retaining groove 12, while each face 11 shares a bevel groove 14 with each face 19.

In FIG. 5, the mast has an L-shaped cross-section, its ends having a width equal to the thickness of a panel, which can, non-restrictively, permit to join two panels at right angles, without extra thickness.

Figure 6:
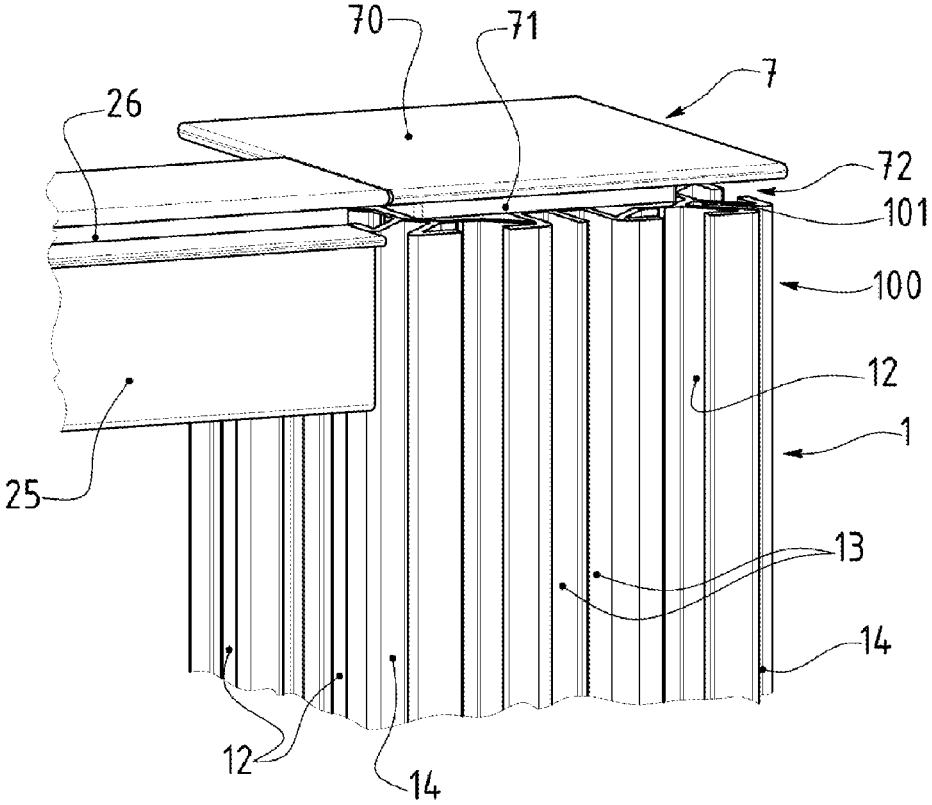
FIG. 6 shows a perspective view of a portion of the same modular system.

When referring now to FIG. 6, one can see a portion of the modular system according to the invention, and more particularly the upper end of a mast 1, which a longitudinal beam 25 is made integral with.

The longitudinal beam 25 is made integral with the mast 1 by one of its ends, and through fastening means, not shown, designed capable of cooperating with a retaining groove 12. It includes on its front wall, a groove 26 intended for the insertion of the horizontal portion of an elastic canvas cord, not shown.

It should be noted that in this configuration the modular system according to the invention does not include any frame stile, the vertical portion of the elastic cord, not shown, being aimed at being inserted into a groove 13 or 14 of the mast 1.

In this figure, one can see that the end 100 of the mast 1 is provided with a cap 7, which is fastened by fitment through internal grooves 15 and/or the axial channel 15', not shown, or other fastening means.

The cap 7 advantageously includes essentially two portions, namely an upper portion 70 being in the form of a wall having the dimensions of the cross-section of the mast 1, and a lower portion 71 the dimensions of which are smaller than those of the cross-section of the mast 1.

The lower portion is aimed at entering into contact with the upper edge 101 of the end 100 of the mast 1, so as to create, between the latter and the wall 70, a groove 72 that extends in the extension of the groove 26 and has a width equal to that of the latter.

One will understand that the groove 72 can receive an elastic cord, which can be an extension of the one received in the groove 26, or be that of the canvas covering the mast.

Furthermore, the groove 72 advantageously communicates with all the grooves 13 and 14, which allows maintaining a canvas without deformation and folds.

It should be noted that a cap 7 can also be provided at the lower end of the mast 1.

In a variant, not shown, one of the ends of the mast 1, or both ends, is provided with a cap that incorporates a peripheral groove.

We claim:

1. A modular partition system comprising:

a panel comprising:

a frame having at least one face;

a panel canvas covering at least a portion of said at least one face of said frame; and a retaining means for attaching said panel canvas to said frame;

wherein said panel canvas has a hooking means on a perimeter thereof, said hooking means being cooperative with said retaining means for attaching said panel canvas to said panel; and a mast, being removably engaged to said panel, said mast comprising:

a profile having at least one face;

a fastening means for engaging said panel to said mast, said fastening means being comprised of a fastening groove;

a mast canvas covering at least a portion of said mast; and a retaining groove means for attaching said mast canvas covering at least a portion of said at least one face of said mast, wherein said mast canvas has a hooking means on a perimeter thereof, said hooking means being cooperative with said retaining groove means for attaching said mast canvas to said mast, and wherein said retaining groove means comprises:

a beveled retaining groove on a beveled face of said profile; and a planar retaining groove on a first face of said profile, said planar retaining groove being perpendicular to said first face.

2. The modular partition system, according to claim 1, wherein said profile has a generally square shape with four faces of equal dimensions, said retaining groove means further comprising additional beveled retaining grooves at corners of said profile and additional planar retaining grooves distributed over a perimeter of said profile of said mast on each face of said profile, said fastening means further comprising additional fastening grooves distributed over a perimeter of said profile of said mast on each face of said profile.

3. The modular partition system, according to claim 2, wherein said beveled retaining groove is positioned between said fastening groove and one of said additional fastening grooves, said beveled face of said profile being adjacent to each face of said profile corresponding to each fastening groove around said beveled retaining groove.

4. The modular partition system, according to claim 1, wherein said fastening groove is positioned between said beveled retaining groove and said planar retaining groove.

5. The modular partition system, according to claim 1, further comprising:

a cap attached to an end of said mast; and a cap fastening means for attaching said cap to an outermost edge of an end of said mast.

6. The modular partition system, according to claim 5, wherein said cap is comprised of an upper portion and a lower portion, said lower portion having a cross-section smaller than a cross-section of said profile of said mast, said cap and said mast forming a peripheral means for retaining a canvas selected from a group consisting of a panel canvas and a mast canvas.

7. The modular partition system, according to claim 2, wherein said profile of said mast has width equal to twice a thickness of said frame of said panel.

8. The modular partition system according to claim 2, wherein said planar retaining groove is adjacent to a complementary planar retaining groove in a same face of said profile, said complementary planar retaining groove being one of said additional planar retaining grooves, wherein said complementary planar retaining groove is adjacent on an opposite side to a complementary fastening groove, said complementary fastening groove being one of said additional fastening grooves, wherein said fastening groove, said planar retaining groove, said complementary planar retaining groove, and said complementary fastening groove are planar on a same face of said profile, said beveled surface of said beveled retaining groove being adjacent to said same face of said profile where said beveled retaining groove is adjacent to said fastening groove, and wherein said additional fastening grooves, said additional planar retaining grooves, and said additional beveled retaining grooves are formed on remaining faces of said profile.

9. The modular partition system, according to claim 1, wherein said profile has a generally rectangular shape with two longer faces of equal dimensions on opposite sides and two shorter faces of equal dimensions on opposite sides, said retaining groove means further comprising additional beveled retaining grooves at corners of said profile and additional planar retaining grooves distributed over a perimeter of said profile of said mast on each face of said profile, said fastening means further comprising additional fastening grooves distributed over a perimeter of said profile of said mast on each face of said profile, wherein said planar retaining groove is adjacent to a complementary planar retaining groove in a same face of said profile, said complementary planar retaining groove being one of said additional planar retaining grooves, wherein said complementary planar retaining groove is adjacent on an opposite side to a complementary fastening groove, said complementary fastening groove being one of said additional fastening grooves, wherein said fastening groove, said planar retaining groove, said complementary planar retaining groove, and said complementary fastening groove are planar on one of said two longer faces of said profile, said beveled surface of said beveled retaining groove being adjacent to said same longer face of said profile where said beveled retaining groove is adjacent to said fastening groove, wherein said additional fastening grooves, said additional planar retaining grooves, and said additional beveled retaining grooves are formed on a remaining longer face of said profile, and on said shorter faces of said profile.

10. The modular partition system, according to claim 1, wherein said profile is generally L-shaped with longer faces on a base and spine of an L-shape of equal dimensions on adjacent and orthogonal to each other and four shorter faces of equal dimensions, said base and said spine being on other sides of the L-shape, said retaining groove means further comprising additional beveled retaining grooves and additional planar retaining grooves distributed over a perimeter of said profile of said mast on each face of said profile, said fastening means further comprising additional fastening grooves distributed over a perimeter of said profile of said mast on each face of said profile, wherein said planar retaining groove is adjacent to a complementary planar retaining groove in a same longer face of said profile, said complementary planar retaining groove being one of said additional planar retaining grooves, wherein said complementary planar retaining groove is adjacent on an opposite side to a complementary fastening groove, said complementary fastening groove being one of said additional fastening grooves, wherein said fastening groove, said planar retaining groove, said complementary planar retaining groove, and said complementary fastening groove are planar on one of said two longer faces of said profile, said beveled surface of said beveled retaining groove being adjacent to said longer face of said profile where said beveled retaining groove is adjacent to said fastening groove, wherein said additional fastening grooves, said additional planar retaining grooves, and said additional beveled retaining grooves are formed on a remaining longer face of said profile, and wherein said additional fastening grooves and said additional beveled retaining grooves are formed on said shorter faces of said profile.

11. The modular partition system, according to claim 10, further comprising:

a re-entrant edge groove formed by two planar retaining grooves adjacent shorter faces of said profile, said two planar retaining grooves being additional planar retaining grooves, said two planar retaining grooves being orthogonal to each other so as to form a bend corner.

12. The modular partition system, according to claim 1, wherein said beveled retaining groove has a rectangular cross-section and an axis parallel to a length of said rectangular cross-section oriented inward of said mast.

13. The modular partition system, according to claim 12, wherein said planar retaining groove has a rectangular cross-section, and an axis parallel to a length of said rectangular cross-section oriented inward of said mast and different from said axis of said beveled retaining groove.

* * * * *